US010247497B2

(12) United States Patent
Lopatin

(10) Patent No.: US 10,247,497 B2
(45) Date of Patent: Apr. 2, 2019

(54) FIREARM GAS REDIRECTION ASSEMBLY

(71) Applicant: Aleksandr Lopatin, Buturlinovka (RU)

(72) Inventor: Aleksandr Lopatin, Buturlinovka (RU)

( * ) Notice: Subject to any disclaimer, the term of this patent is extended or adjusted under 35 U.S.C. 154(b) by 0 days.

(21) Appl. No.: 15/613,990

(22) Filed: Jun. 5, 2017

(65) Prior Publication Data

US 2018/0347926 A1 Dec. 6, 2018

(51) Int. Cl.

| | |
|---|---|
| ***F41A 3/26*** | (2006.01) |
| ***F41A 5/02*** | (2006.01) |
| ***F41C 3/00*** | (2006.01) |
| ***F41A 3/66*** | (2006.01) |
| ***F41A 21/36*** | (2006.01) |
| ***F41A 5/24*** | (2006.01) |
| ***F41A 5/26*** | (2006.01) |

(52) U.S. Cl.

CPC *F41A 5/02* (2013.01); *F41A 3/26* (2013.01); *F41A 3/66* (2013.01); *F41A 5/24* (2013.01); *F41A 5/26* (2013.01); *F41A 21/36* (2013.01); *F41C 3/00* (2013.01)

(58) Field of Classification Search

CPC ..... F41A 3/26; F41A 21/36; F41A 21/38
USPC ..... 89/14.3
See application file for complete search history.

(56) References Cited

U.S. PATENT DOCUMENTS

| | | | | |
|---|---|---|---|---|
| 3,368,298 A * | 2/1968 | Browning | F41A 3/26 | 42/16 |
| 4,010,673 A * | 3/1977 | Kepplinger | F41A 3/62 | 89/191.02 |
| 4,058,050 A * | 11/1977 | Brouthers | F41A 21/36 | 89/14.3 |
| 4,373,423 A * | 2/1983 | Moore | F41A 5/26 | 89/191.02 |
| 4,798,124 A | 1/1989 | Hurlemann | | |
| 8,091,263 B1 | 1/2012 | Palmer | | |
| 8,322,266 B2 | 12/2012 | Presz, Jr. et al. | | |
| 8,584,575 B2 | 11/2013 | Crommett | | |
| 8,640,598 B1 * | 2/2014 | Jackson | F41A 5/20 | 89/191.01 |
| 8,671,818 B1 | 3/2014 | Oliver | | |
| 9,097,475 B2 | 8/2015 | Ricks | | |
| 9,423,197 B2 | 8/2016 | Gomez | | |

* cited by examiner

*Primary Examiner* — Stephen Johnson

(74) *Attorney, Agent, or Firm* — Vincent G. LoTempio; Kloss, Stenger & LoTempio; David T. Stephenson

(57) ABSTRACT

A firearm gas redirection assembly directionally directs discharged gases from a barrel towards a bolt frame, and uses the energy from discharged gases to force a bolt rearwardly in an action. The barrel has an elongated body, an inner barrel sidewall, an outer barrel sidewall, a rear end, and a forward end. The forward end of barrel forms gas vents. The barrel is fixed motionless on the frame of the weapon. A jet nozzle concentrically couples around the barrel and integrates with a bolt frame. The jet nozzle has inner and outer jet sidewalls and a jet nozzle edge. The inner jet sidewall and outer barrel sidewall form a gas space that is in communication with the bolt frame. Discharge of firearm forces high velocity gas through gas vents that form in the barrel, through gas space, and finally against the jet nozzle edge. This forces bolt frame rearwardly.

14 Claims, 7 Drawing Sheets

FIREARM GAS REDIRECTION ASSEMBLY

FIELD OF THE INVENTION

The present invention relates generally to a firearm gas redirection assembly. More so, the present invention relates to a firearm barrel that directionally directs the discharged gases generated by a projectile from a firearm barrel towards a jet nozzle edge, using the energy from the discharged powder gases to force the bolt frame rearwardly; whereby a bolt frame comprises a bolt frame lip surface and a bolt that is operable to slide rearwardly immediately upon discharge of the firearm, and the bolt is further operable to recoil and slide forward after discharge of the firearm; whereby a barrel is defined by an elongated body, an inner barrel sidewall, an outer barrel sidewall, a rear end, and a forward end terminating at a muzzle; whereby the forward end of the barrel forms at least one gas vent; the barrel is fixed motionless on the frame of the weapon; whereby a jet nozzle concentrically couples around the barrel and integrates with the bolt frame, and the jet nozzle is defined by an inner jet sidewall, an outer jet sidewall, and a jet nozzle edge; whereby the inner jet sidewall and the outer barrel sidewall form a gas space that is in communication with the bolt frame; whereby discharge of the firearm forces a high velocity gas through from the at least one gas vent against the jet nozzle edge through the gas space, so as to displace the bolt frame rearwardly.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, Semi-automatic pistols generally include a frame having a grip portion for grasping by the user, barrel defining a chamber for holding a cartridge, trigger-actuated firing mechanism for cocking and releasing a striker or hammer to detonate the cartridge, and an axially reciprocating bolt. The bolt defines a breach block for forming an openable and closeable breech with the rear of the chamber as well known to those skilled in the art.

It is known in the art that a bolt assembly is required in a firearm to manage recoil in order to effectively absorb the kinetic energy generated by gases form the discharged projectile. The bolt is a mechanical part of a firearm that blocks the rear of the chamber while the propellant burns, but moves out of the way to allow another cartridge or shell to be inserted in the chamber. This helps manage the recoil of the high velocity gases against the bolt.

Other proposals have involved removing gases and the energy needed to perform a cycle of automation and reloading that are generated in a barrel discharged projectiles. The problem with these is that they require a massive and bulky gas chamber for removing part of the powder gases, and also a gas piston. Even though the above cited gas redirecting assemblies meet some of the needs of the market, a firearm gas redirection assembly that directed directs the discharged gases generated by a projectile from a firearm barrel towards a bolt frame, using the energy from the discharged powder gases to force the bolt frame backward is still desired.

SUMMARY

Illustrative embodiments of the disclosure are generally directed to a firearm gas redirection assembly. The firearm gas redirection assembly serves to directional direct discharged gases generated by a projectile from a firearm barrel against a jet nozzle edge, and then use the energy from the discharged powder gases to force the bolt frame backward. The bolt frame is operable to slide backward immediately upon discharge of the firearm, and the bolt frame is further operable to recoil by sliding forward after discharge of the firearm.

The barrel is defined by an elongated body, an inner barrel sidewall, an outer barrel sidewall, a rear end, and a forward end terminating at a muzzle. The forward end of the barrel forms at least one gas vent. The barrel is fixed motionless on the frame of the weapon. A jet nozzle concentrically couples around the barrel. Jet nozzle also integrates with bolt frame. The jet nozzle is defined by an inner jet sidewall, an outer jet sidewall barrel, and a jet nozzle edge. The inner jet sidewall and the outer barrel sidewall form a gas space that is in communication and integrated with the bolt frame, and axially in communication with the bolt. In this manner, discharge of the firearm forces a high velocity gas through from the at least one gas vent in the barrel, against the jet nozzle edge, and to the bolt frame for displacement, through the gas space. As a result, the bolt frame and bolt are moved rearwardly in relation to the barrel.

In one aspect, a firearm barrel gas redirection assembly, comprises:

a bolt frame comprising a bolt frame lip surface and a bolt, the bolt operable to slide rearwardly immediately upon discharge of the firearm, the bolt further operable to recoil slide forward after discharge of the firearm;

a barrel defined by an elongated body, an inner barrel sidewall, an outer barrel sidewall, a rear end, and a forward end terminating at a muzzle, the forward end forming at least one gas vent; the barrel is fixed motionless on the frame of the weapon; and a jet nozzle concentrically coupled around the barrel, the jet nozzle integrated with the bolt frame, the jet nozzle defined by an inner jet sidewall, an outer jet sidewall, and a jet nozzle edge, whereby the inner jet sidewall and the outer barrel sidewall form a gas space that is in communication with the bolt frame, whereby discharge of the firearm forces a high velocity gas through from the at least one gas vent against the jet nozzle edge through the gas space, whereby the discharged gas displaces the bolt frame rearwardly.

In another aspect, the firearm is a pistol.

In another aspect, the at least one gas vent comprises multiple gas vents forming a circle around the outer barrel sidewall.

In another aspect, the barrel comprises a barrel logging lug.

In another aspect, the bolt frame is axially aligned with the barrel.

In another aspect, the cylindrical jet nozzle couples outside the muzzle.

In another aspect, the bolt frame comprises a striker concentric to the bolt.

In another aspect, the barrel has an arbitrary cross-sectional shape that is different from round or barrel-like.

In another aspect, the jet nozzle integrated or communicating with the bolt frame has a cross-sectional shape that is different from round or barrel shaped.

In another aspect, the bolt frame is not equal in length and is not aligned with the muzzle of the trunk in the normal state.

In another aspect, the muzzle barrel may have o-rings, as well as protuberances of arbitrary shape, to increase pressure in the gas space.

In another aspect, the jet nozzle is integrated into the bolt frame.

In another aspect, the jet nozzle is a separate piece communicating with the bolt frame.

In another aspect, the bolt does not have a bolt frame and it works independently.

In another aspect, the jet nozzle acts directly on the bolt.

In another aspect, the bolt works with the bolt frame and the bolt frame acts on the bolt, allowing the bolt to open and close, and also moving the bolt back and forth to reload the weapon.

In another aspect, the bolt frame comprises a rotary cam.

In another aspect, the assembly is operational with a firearm.

In another aspect, the firearm further comprises a frame.

In another aspect, the frame comprises a metal housing and a handle.

One objective of the present invention is to redirect the energy from gases generated by a discharged projectile to displace a bolt frame and bolt rearwardly.

Another objective is to provide a firearm does not require a massive and bulky gas chamber for removing part of the powder gases.

Another objective is to provide a firearm that does not require a gas piston.

Yet another objective is to form gas vents in the front end of the barrel.

Yet another objective is to combine the jet nozzle with the side openings for the removal of powder gases from the barrel.

Yet another objective is to provide an inexpensive firearm accessory that creates more efficient bolt frame and bolt action.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
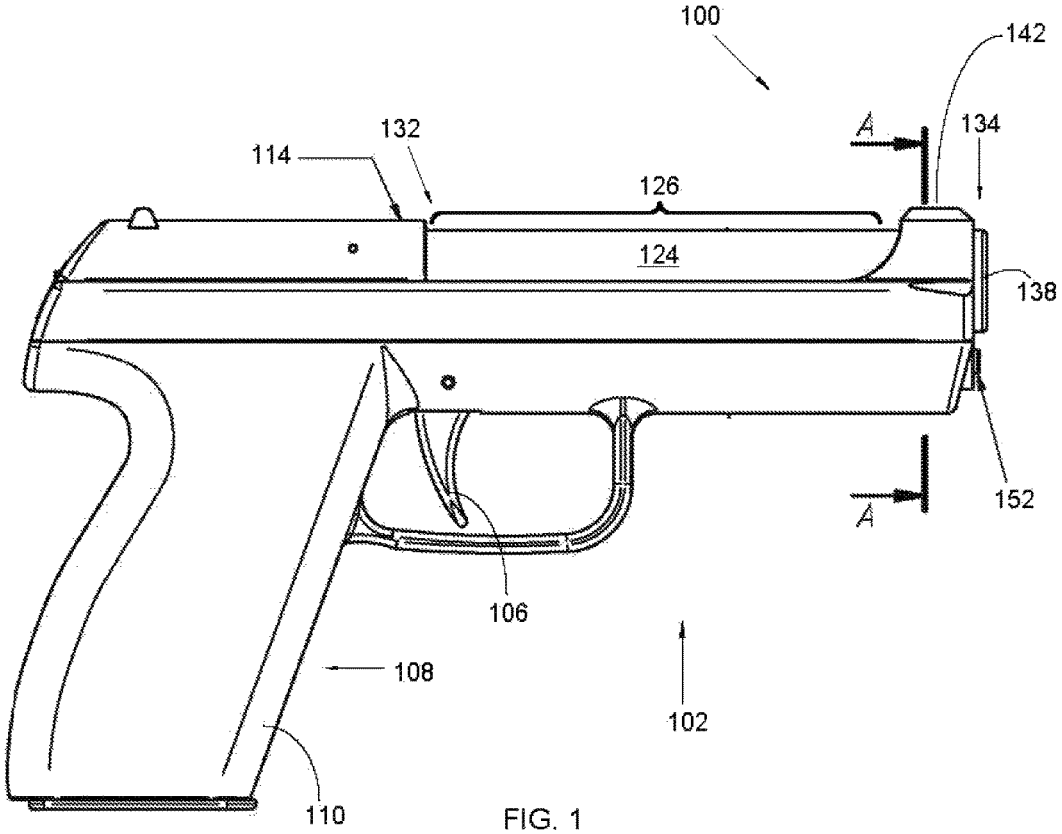
FIG. 1 illustrates a right side view of an exemplary firearm gas redirection assembly, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A firearm gas redirection assembly 100 is referenced in FIGS. 1-10. Firearm gas redirection assembly 100, hereafter "assembly 100" is operable with a firearm to directionally direct discharged gases 158 generated by a projectile from a barrel 124 towards a bolt frame 114, and then use the energy from the discharged gas to force a bolt frame 114 rearwardly in a single action. The essence of the invention is that the firearm 102 does not require a massive and bulky gas chamber and gas piston for removing part of the powder gases. Rather, the gases 158 generated by the discharge of the projectile are redirected rearwardly and in alignment with the barrel 124 to displace the bolt frame 114 rearwardly.

As shown in FIG. 1, firearm 102 of the present disclosure may include a pistol, as known in the art. Though in other embodiments, firearm 102 may include, without limitation, a semi-automatic firearm, an automatic firearm, a derringer, a rifle, a shotgun, a machine gun, and a large artillery weapon. Firearm 102 is defined by a firearm frame 104, which can be a metal housing 108 that also serves as the handle 110, or grip, of the firearm. Handle 110 may contain a feeder clip 148, as commonly used in a pistol or other handgun known in the art.

Figure 2A:
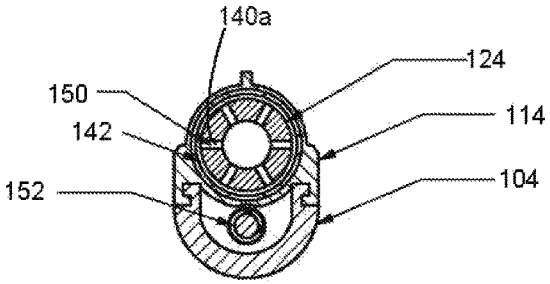
FIG. 2A illustrates a frontal view of the firearm gas redirection assembly, the section taken along section A-A of FIG. 1, detailing barrel and attached jet nozzle, showing the gas vent and gas space formed therebetween, in accordance with an embodiment of the present invention.

As FIG. 2A shows, a unique aspect of assembly 100 for purposes of this invention, is an elongated metal barrel 124 that extends forwardly from firearm 102 to carry a projectile during discharge. Barrel 124 is defined by at least one gas vent 140*a-f,* and a jet nozzle 142 that aligned to a forward end 134 of the barrel 124. The barrel 124 is fixed motionless on the frame 108 of the weapon.

Figure 2B:
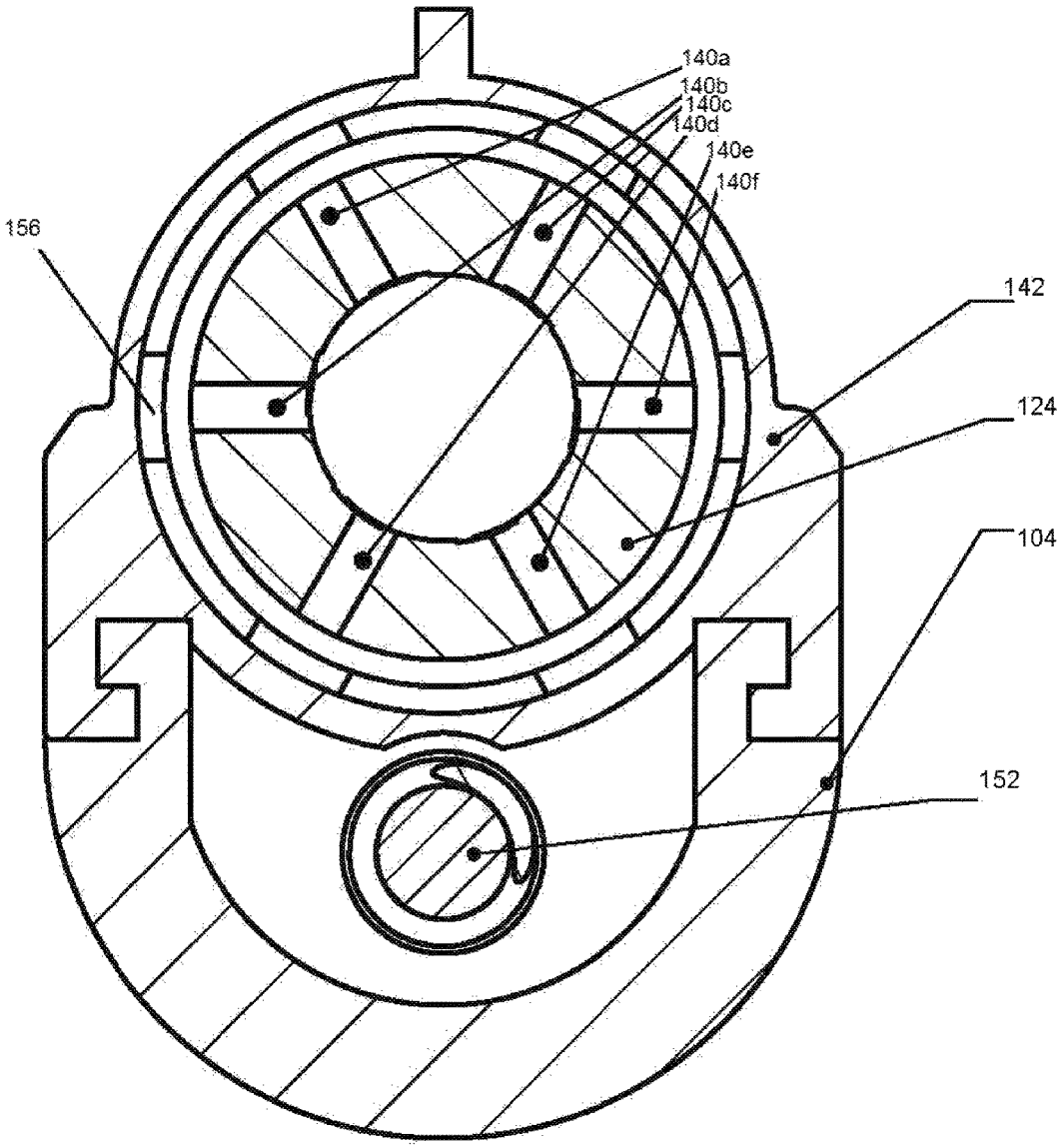
FIG. 2B illustrates a frontal of a barrel for the firearm gas redirection assembly, detailing the gas vents and attached jet nozzle, in accordance with an embodiment of the present invention.

Looking at FIG. 2B, a gas space 150 forms between barrel 124 and jet nozzle 142. Gas space 150 may include a thin gap that is in communication with both barrel 124 and bolt frame 114. As a projectile is discharged, the consequentially formed gases are directionally funneled out the gas vent 140*a-f,* and then into the gas space 150, before finally engaging normal against a jet nozzle edge 160 that is integrated with the bolt frame 114. This causes bolt frame 114, and subsequently the bolt 116, to be displaced rearwardly in relation to barrel 124 and jet nozzle 142.

Figure 3:
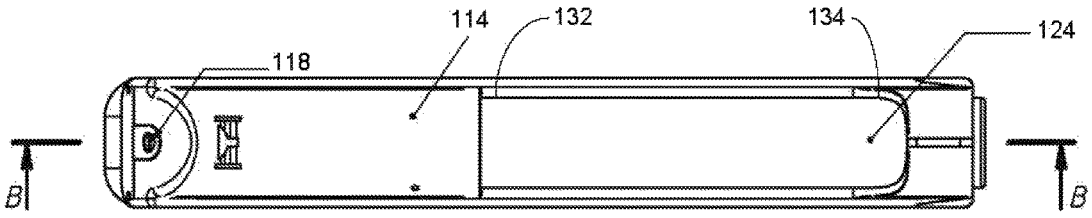
FIG. 3 illustrates a top view of the firearm gas redirection assembly shown in FIG. 1, in accordance with an embodiment of the present invention.

As shown in FIG. 3, firearm 102 may also be defined by an action, which is part of the trigger member 106, and which contains the components of the firearm 102 that fire the projectile. The action may include a rod return spring 152 and a recoil spring 154. A rotary cam 112 may also be used to help in articulation during the action of the firearm 102.

Most significantly however, firearm 102 comprises a barrel 124, which is a metal tube that the projectile travels through. The forward end 134 of barrel 124 is fitted with a cylindrical jet nozzle 142 that works in conjunction with the barrel 124 to redirect discharged gases normal to a bolt frame. In this manner, the bolt frame 114 and bolt 116 is displaced rearwardly, away from the barrel 124 to absorb the force and also to enable loading of a new projectile.

Figure 4:
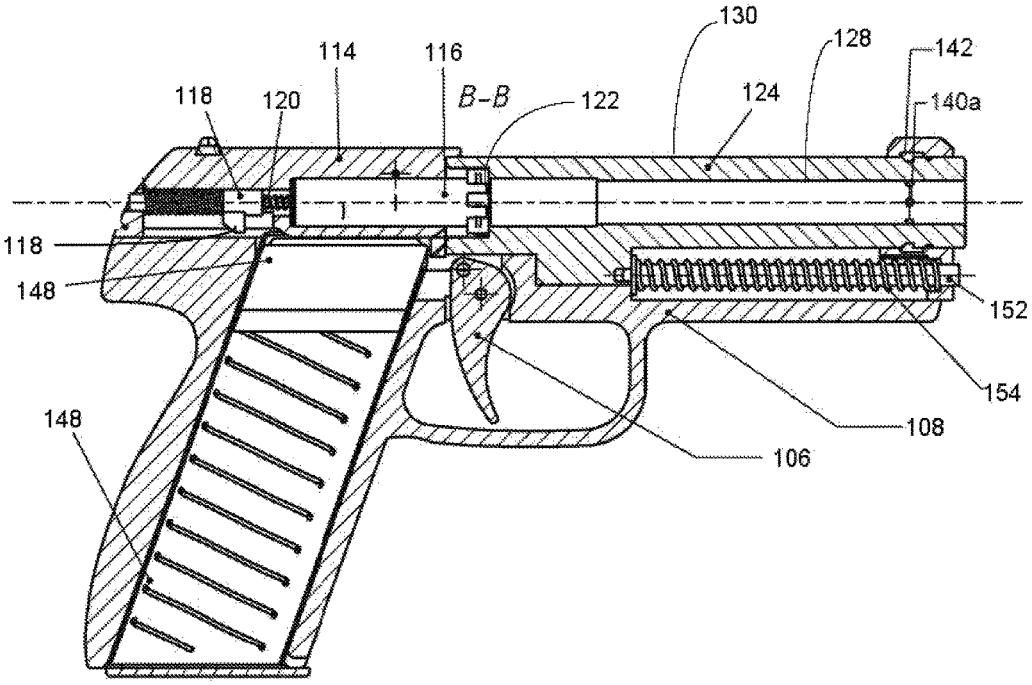
FIG. 4 illustrates a sectioned side view of the firearm gas redirection assembly, the section taken along section B-B of FIG. 3, detailing the bolt frame, trigger action, barrel, and jet nozzle, in accordance with an embodiment of the present invention.

Turning now to FIG. 4, firearm 102 also utilizes a bolt frame 114 that comprises a bolt frame lip surface 103 and a bolt 116. The bolt frame 114, together with a bolt blocks the rear of the projectile chamber while the propellant burns, but moves out of the way to allow another cartridge or shell to be inserted in the chamber. In another embodiment, bolt frame 114 comprises a bolt locking lug 122 to attach bolt frame 114 to barrel 124. Also, the bolt frame 114 comprises a striker 118 that is concentric to the bolt 116. The striker 118 is in a spring-loaded state, under the action of the springs of the striker 120. The striker 118 serves to ignite the charge.

Bolt frame 114 comprises a bolt 116 that is operable to slide rearwardly immediately upon discharge of the firearm 102, so as to enable a new projectile, i.e. bullet, can be loaded into the chamber. Bolt 116 is further operable to recoil by sliding forward after discharge of the firearm to load the newly loaded projectile. Bolt 116 is axially aligned with the barrel 124, so that when the charge in the cartridge ignites, the gas presses on the cartridge sleeve and presses the bolt 116 through the sleeve. Bolt 116 is held fixed by the bolt locking lug 122 during firing, forcing all the expanding gas 158 forward, and is manually withdrawn to chamber another round.

Figure 5:
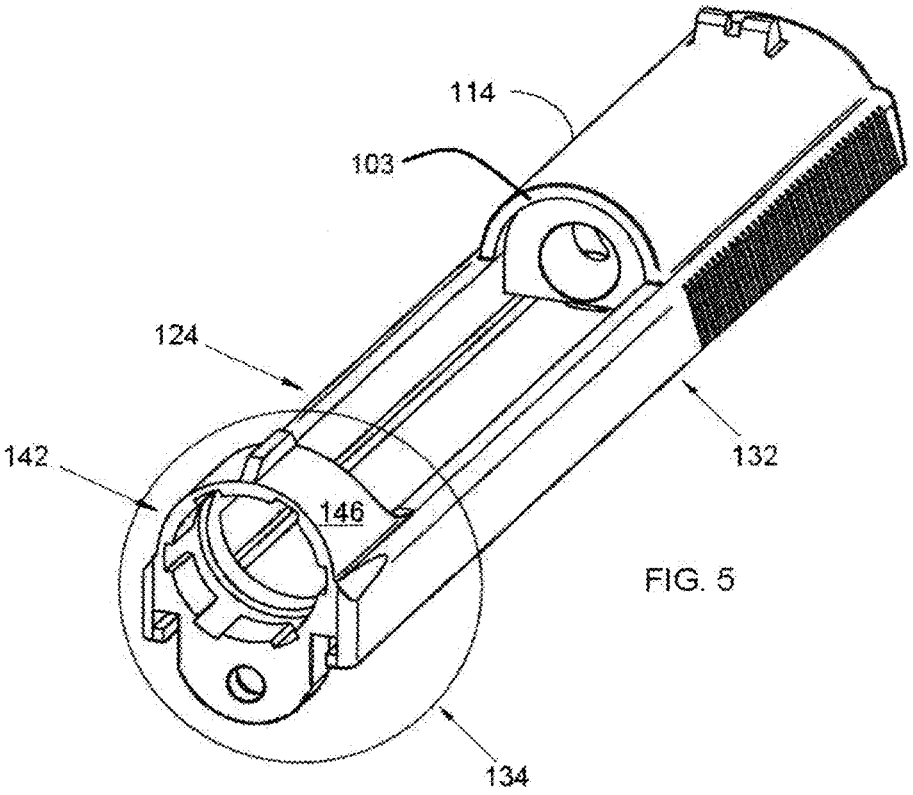
FIG. 5 illustrates a perspective view of the front end of the barrel, in accordance with an embodiment of the present invention.

Looking at FIG. 5, barrel 124 is defined by an elongated, metal body. In one embodiment, barrel 124 functionally operates like a pressure vessels, and is fabricated of a durable and strong material such as steel to withstand the combustion forces and temperatures associated with firing firearm 102. Barrel 124 is further defined by an inner barrel sidewall 128, an outer barrel sidewall 130, a rear end 132, and a forward end 134. Forward end 134 terminates at a muzzle 138. The barrel 124 is fixed motionless on the frame 108 of the weapon. Barrel 124 may include an elongated metal tube fabricated from steel, titanium, and metal alloys known in the art.

In one embodiment, forward end 134 of barrel 124 forms at least one gas vent 140*a-f.* Gas vent 140*a-f* provides an escape for the discharged gases 158 that are generated by a discharged projectile, and normally exit from muzzle 138 of barrel 124. Gas vent 140*a-f* extends into barrel sidewalls 128, 130. In some embodiments, multiple gas vents 140*a-f* form in barrel 124 in equal number, and in alignment on opposing sides of barrel 124. In another embodiment, multiple gas vents 140*a-f* are arranged around the periphery of the forward end of the barrel. In some embodiments, barrel 124 may also utilize a barrel locking lug 136 to attach barrel 124 to a firearm action. This is possible as the barrel locking lugs 136 engage the bolt locking lug 122, providing closure of the bore of the barrel 124 upon firing.

Figure 6:
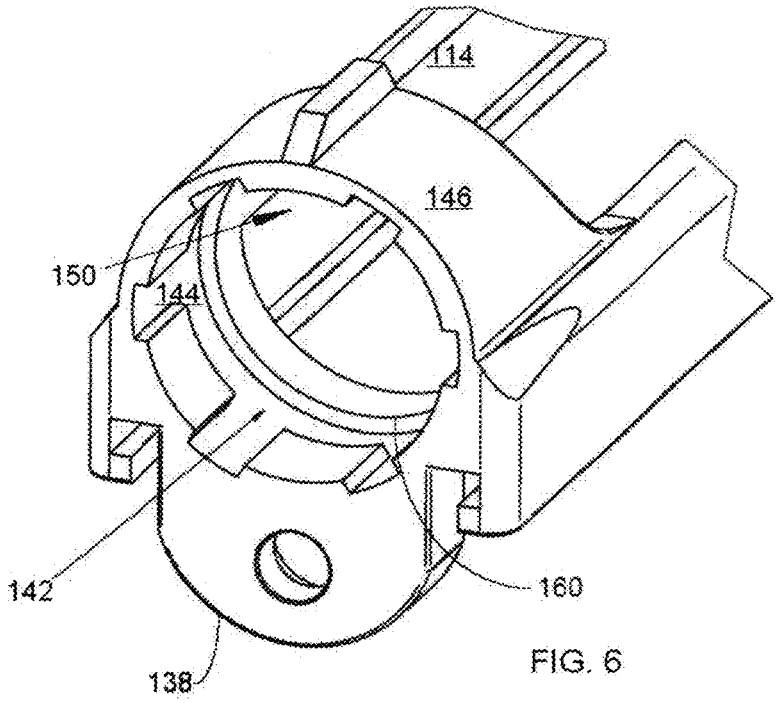
FIG. 6 illustrates a close up view of the front end of the barrel, detailing the jet nozzle and gas space that forms with the barrel, in accordance with an embodiment of the present invention.

As the close up view of FIG. 6 depicts, assembly 100 further comprises a jet nozzle 142 configured to redirect the high velocity discharged gas towards bolt frame 114. Jet nozzle 142 is disposed to concentrically couple around barrel 124. In one embodiment, jet nozzle 142 couples outside the muzzle 138. Jet nozzle 142 may either fixedly or detachably attach to muzzle 138.

In some embodiments, jet nozzle 142 is defined by an inner jet sidewall 144, an outer jet sidewall 146, and a jet nozzle edge 160. The inner jet sidewall 144 and the outer barrel sidewall 130 form a gas space 150 that is in communication with bolt frame 114, and axially in communication with the bolt 116. In this manner, discharge of the firearm forces a high velocity gas through the at least one gas vent 140*a-f* and into barrel 124.

Figure 7:
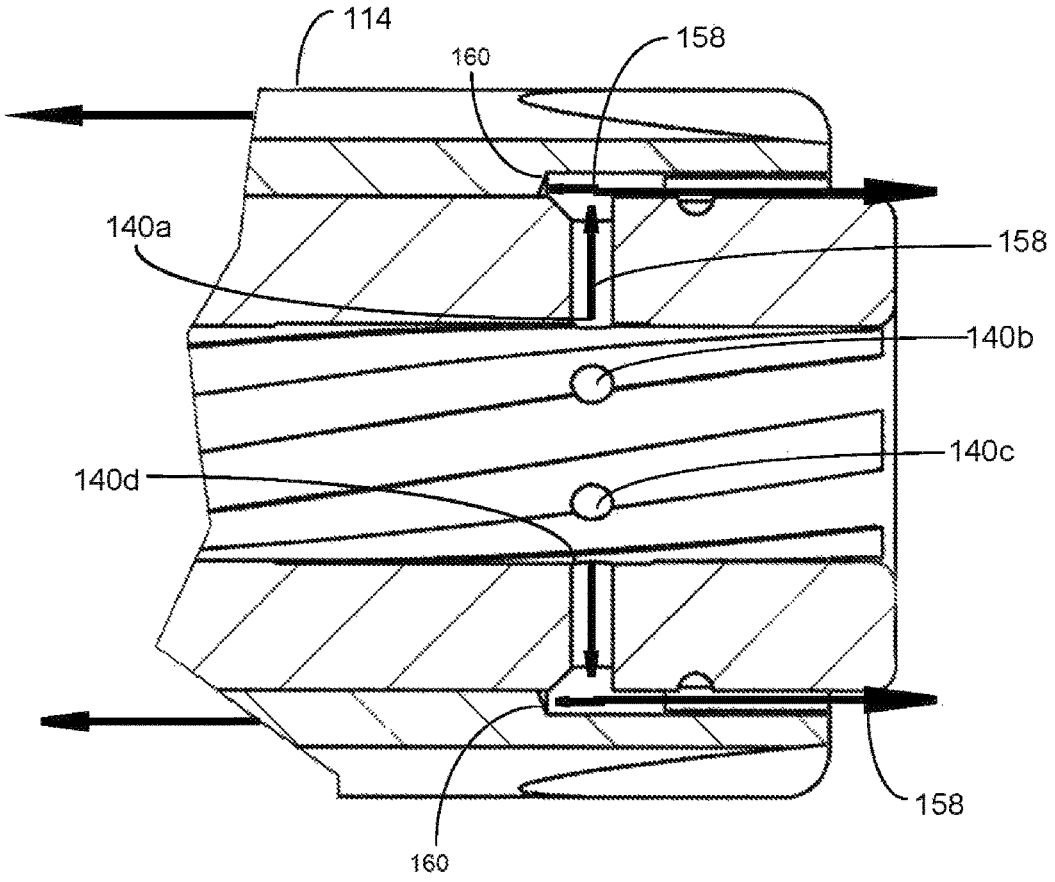
FIG. 7 illustrates a close up sectioned view of forward end of barrel, detailing the gas passing through the jet nozzles, and then passing through the gas space in two directions to discharge from the muzzle, and also to engage the bolt frame lip surface that forms in the bolt frame, so as to rearwardly displace the bolt frame, in accordance with an embodiment of the present invention.

FIG. 7 illustrates a close up sectioned view of forward end 134 of barrel 124, detailing the gas 158 passing through two jet nozzles, and then passing through the gas space 150 in two directions. Here, gas 158 passes from the muzzle 138, and also passes in opposite direction to engage jet nozzle edge 160 that is integrated with bolt frame 114. As gas 158 engages jet nozzle edge 160, the bolt frame 114 is rearwardly displaced to create an action. This action occurs at high speed and in real time, quickly recoiling back to the starting position through use of spring 152, 154. In one alternative embodiment, the gas engages a jet nozzle edge 160 to push the bolt frame 114 rearwardly. This is possible since the jet nozzle 142 is integrated with the bolt frame 114.

Figure 8:
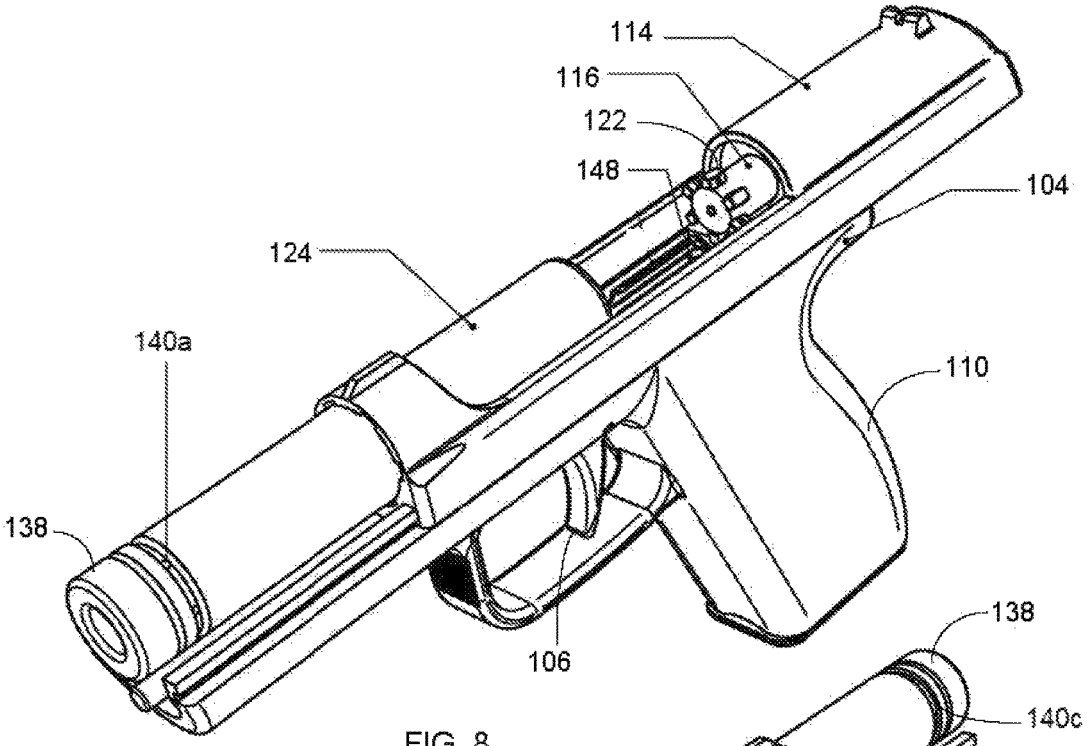
FIG. 8 illustrates a front angle perspective view of the firearm gas redirection assembly shown in FIG. 1, in accordance with an embodiment of the present invention.
Figure 9:
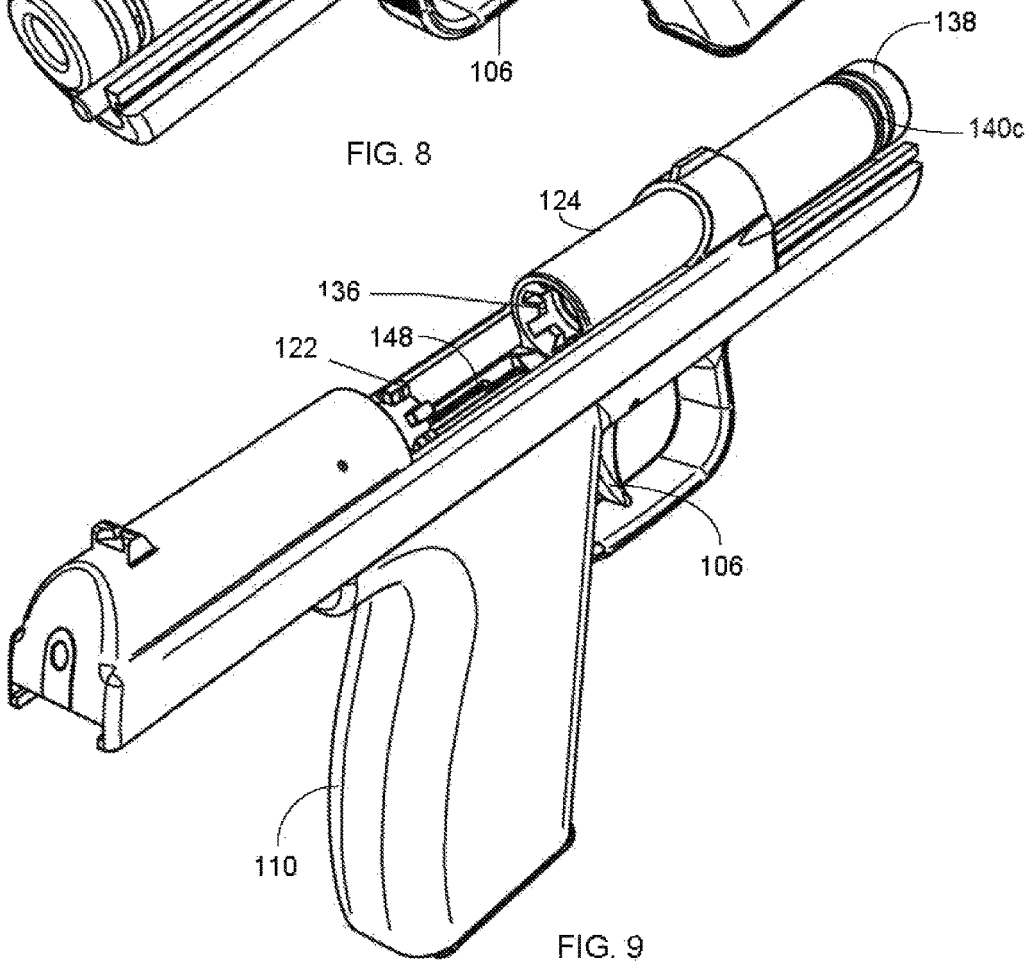
FIG. 9 illustrates a rear angle perspective view of the firearm gas redirection assembly shown in FIG. 1, in accordance with an embodiment of the present invention.

Looking now at the forward and rearward view of FIGS. 8 and 9, and as discussed above, a unique aspect of assembly 100 is that the forward end 134 of the barrel 124 forms multiple, equidistant gas vents 140*a-f.* Gas vent 140*a-f* provides an escape for the discharged gases of a discharged projectile to exit. The powder gas exits the barrel 124 and passes between outer barrel sidewall 130 and the inner jet sidewall 144. The powder gas expands, engaging jet nozzle edge 160, forcing a bolt frame 114 to move in the opposite direction, backwards. Thus, bolt frame 114 sliding rearwardly and opens the bolt 116. Then moving further, together with bolt 116, the bolt frame 114 carries out a cycle of automation.

Figure 10:
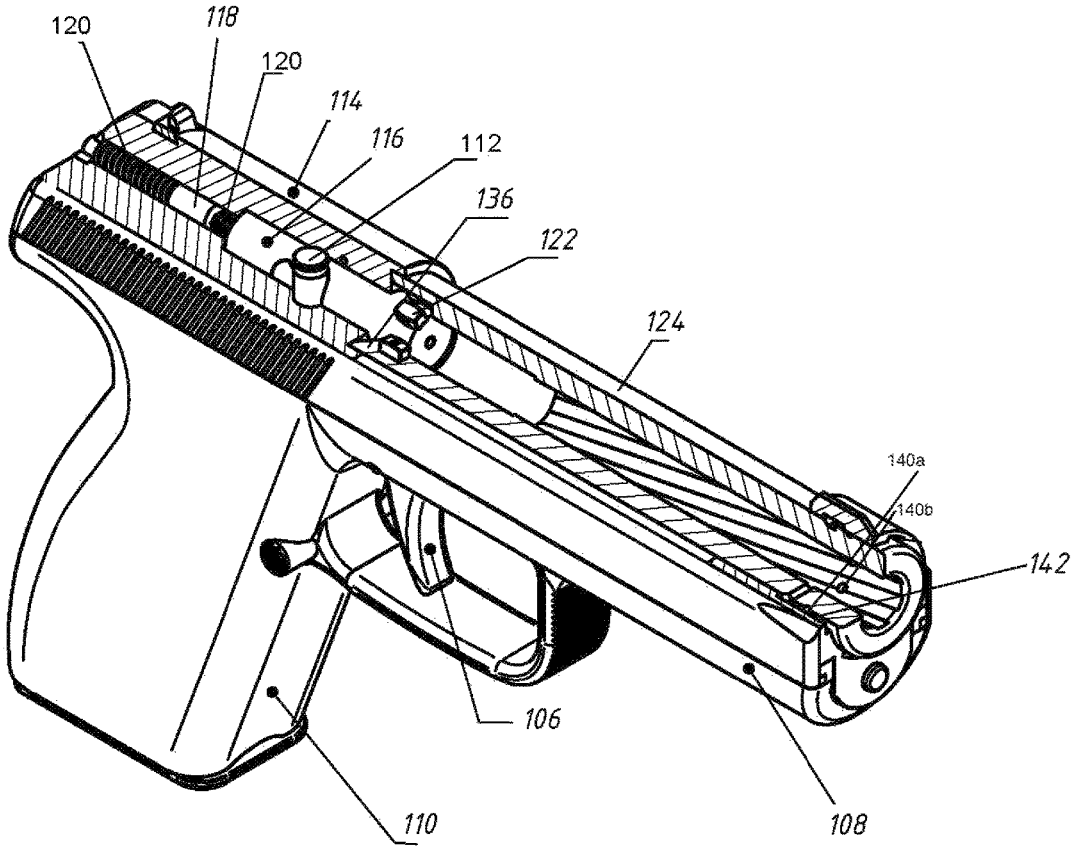
FIG. 10 illustrates a perspective view of the front angle of the small arms, with the longitudinal section of the quarter of the barrel and the bolt frame, in accordance with an embodiment of the present invention.

FIG. 10 shows an assembly 100 entirely in a normal position with a longitudinal notch. Here we see the bolt 116 in the front closed position. The bolt locking lugs 122 of bolt 116 engage the barrel locking lugs 136 of the barrel 124. In this manner, bolt 116 reliably locks channel barrel 124 when fired. The jet nozzle 142 is aligned with the exhaust gas escape openings 140. Also shown is a rotary cam 112 that enters the shaped cutout of the bolt 116. The rotary cam 112 acting on the shaped cutout of the bolt 116 opens and closes the bolt 116.

At the beginning of the cycle, the powder gases act on the bolt frame 114 with a large amount of force necessary to turn and open the bolt 116. This causes the jet nozzle 142 to be forcibly displaced rearward, until jet nozzle 142 ceases to cover with the gas vent 140*a-f*. This leaves a free space for the gas powder to expand unchecked by jet nozzle 142. However in some embodiments, bolt frame 114 continues to move back under the action of the residual pressure of the powder gases in barrel 124 for the automation cycle. Together with a buffer, this provides soft operation of the automation.

Furthermore, since bolt frame 114 does not absorb strong shock loads, bolt frame 114 can be fabricated of steel or titanium. In the case of making bolt frame 114 from titanium, the impulse of recoil of the firearm during discharge is significantly less, since the moving parts during the discharge (bolt 116 and bolt frame 114) is easier in the aggregate. Thus, assembly 100 is operable in two types of shock-trigger mechanism: a shock-trigger mechanisms; and a striker or trigger type.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A firearm gas redirection assembly, the assembly comprising:

a bolt frame comprising a bolt frame lip surface and a bolt, the bolt operable to slide rearwardly immediately upon discharge of a firearm, the bolt further operable to recoil slide rearwardly after discharge of the firearm, the bolt frame further comprising a striker concentric to the bolt, the bolt frame further comprising a rotary cam that opens the bolt;

a barrel defined by an elongated body, an inner barrel sidewall, an outer barrel sidewall, a rear end, and a forward end terminating at a muzzle, the forward end forming at least one gas vent; the barrel is fixed motionless on the frame, the barrel further being defined by a barrel locking lug; and a jet nozzle concentrically coupled around the barrel, the jet nozzle integrated with the bolt frame, the jet nozzle defined by an inner jet sidewall, an outer jet sidewall, and a jet nozzle edge, whereby the inner jet sidewall and the outer barrel sidewall form a gas space that is in communication with the bolt frame, whereby discharge of the firearm forces a gas through from the at least one gas vent against the jet nozzle edge through the gas space, whereby the discharged gas displaces the bolt frame rearwardly.

2. The assembly of claim 1, wherein the at least one gas vent comprises multiple gas vents arranged in a circle around the barrel sidewalls.

3. The assembly of claim 1, wherein the bolt frame is axially aligned with the barrel.

4. The assembly of claim 1, wherein the jet nozzle couples outside the muzzle.

5. The assembly of claim 1, wherein the bolt frame comprises a bolt locking lug.

6. The assembly of claim 1, wherein the assembly is operational with a firearm.

7. The assembly of claim 6, wherein the firearm is a pistol.

8. The assembly of claim 7, wherein the firearm comprises a firearm frame.

9. The assembly of claim 8, wherein the firearm frame comprises a metal housing and a handle, the handle containing a feeder clip.

10. The assembly of claim 9, wherein the firearm comprises a rod return spring and a recoil spring.

11. A firearm gas redirection assembly, the assembly comprising:

a firearm frame;

a rotary cam;

a bolt frame comprising a bolt frame lip surface and a bolt, the bolt operable to slide rearwardly immediately upon discharge of the firearm, the bolt further operable to recoil slide forward after discharge of a firearm;

a barrel defined by an elongated body, an inner barrel sidewall, an outer barrel sidewall, a rear end, and a forward end terminating at a muzzle, the forward end forming at least one gas vent, the barrel is fixed motionless on the frame of the weapon;

whereby the bolt frame is axially aligned with the barrel; and a jet nozzle concentrically coupled around the barrel, the jet nozzle integrated with the bolt frame, the jet nozzle defined by an inner jet sidewall, an outer jet sidewall, and a jet nozzle edge, whereby the inner jet sidewall and the outer barrel sidewall form a gas space that is in communication with the bolt frame, whereby discharge of the firearm forces a gas through from the at least one gas vent against the jet nozzle edge through the gas space, whereby the discharged gas displaces the bolt frame rearwardly.

12. The assembly of claim 11, wherein the at Least one gas vent comprises multiple gas vents forming a circle around the barrel sidewalls.

13. The assembly of claim 12, wherein the bolt frame comprises a striker concentric to the bolt.

14. A firearm gas redirection assembly, the assembly consisting of:

a firearm frame, the firearm frame comprising a metal housing and a handle;

a rotary cam;

a bolt frame comprising a bolt frame lip surface and a bolt, the bolt operable to slide rearwardly immediately upon discharge of the firearm, the bolt further operable to recoil slide rearward after discharge of the firearm, the bolt frame further comprising a striker concentric to the bolt;

a barrel defined by an elongated body, a barrel locking lug, an inner barrel sidewall, an outer barrel sidewall, a rear end, and a forward end terminating at a muzzle, the forward end forming multiple gas vents, the barrel is fixed motionless on the frame;

whereby the bolt frame is axially aligned with the barrel; and a cylindrical jet nozzle concentrically coupled around the barrel, the cylindrical jet nozzle integrated with the bolt frame, the cylindrical jet nozzle defined by an inner jet sidewall, an outer jet sidewall, and a jet nozzle edge, whereby the inner jet sidewall and the outer barrel sidewall form a gas space that is in communication with the bolt frame, whereby discharge of the firearm forces a gas through from the at least one gas vent against the jet nozzle edge through the gas space, whereby the discharged gas displaces the bolt frame rearwardly.

* * * * *